US008864471B2

(12) United States Patent
Duong et al.

(10) Patent No.: US 8,864,471 B2
(45) Date of Patent: Oct. 21, 2014

(54) GAS TURBINE ROTOR WITH PURGE BLADES

(75) Inventors: Loc Quang Duong, San Diego, CA (US); Xiaolan Hu, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 579 days.

(21) Appl. No.: 13/208,565

(22) Filed: Aug. 12, 2011

(65) Prior Publication Data

US 2013/0039770 A1 Feb. 14, 2013

(51) Int. Cl.
*F01D 5/14* (2006.01)
*F01D 5/08* (2006.01)

(52) U.S. Cl.
CPC ..... *F01D 5/082* (2013.01); *F05D 2260/601* (2013.01)
USPC ..... 416/198 R; 416/201 R; 416/198 A; 416/203; 416/175; 416/146 R

(58) Field of Classification Search
CPC ..... F01D 5/02; F01D 5/141
USPC ..... 416/198 R, 201 R, 198 A, 203, 175
See application file for complete search history.

(56) References Cited

U.S. PATENT DOCUMENTS

| | | | | |
|---|---|---|---|---|
| 4,480,958 | A | 11/1984 | Schlechtweg | |
| 5,123,813 | A | 6/1992 | Przytulski et al. | |
| 5,281,097 | A | 1/1994 | Wilson et al. | |
| 6,416,282 | B1 | 7/2002 | Beeck et al. | |
| 6,488,473 | B1 | 12/2002 | Lee et al. | |
| 7,097,429 | B2 | 8/2006 | Athans et al. | |
| 7,306,430 | B2 | 12/2007 | Russ | |
| 7,419,357 | B2 | 9/2008 | Nohr et al. | |
| 7,775,107 | B2 | 8/2010 | Holmquist | |
| 7,845,910 | B2 | 12/2010 | Talasco et al. | |
| 8,157,514 | B2 * | 4/2012 | Reyes et al. | 415/199.4 |
| 8,262,342 | B2 * | 9/2012 | Morris et al. | 415/115 |
| 8,277,169 | B2 * | 10/2012 | Riahi et al. | 415/115 |
| 8,282,346 | B2 * | 10/2012 | Deodhar et al. | 415/174.5 |
| 8,317,465 | B2 * | 11/2012 | Smith | 415/173.6 |
| 2009/0136349 | A1 | 5/2009 | Dezouche | |
| 2009/0142195 | A1 | 6/2009 | Brittingham et al. | |
| 2009/0155077 | A1 | 6/2009 | Kombowski | |
| 2010/0189562 | A1 | 7/2010 | Blanchard et al. | |

* cited by examiner

*Primary Examiner* — Ninh H Nguyen
(74) *Attorney, Agent, or Firm* — Carlson, Gaskey & Olds, PC

(57) ABSTRACT

A rotor for a gas turbine engine includes a plurality of turbine blades extending radially outwardly of a rotor body. A plurality of purge blades are positioned to rotate with the rotor body, and to drive air radially outwardly toward the turbine blades.

15 Claims, 3 Drawing Sheets

GAS TURBINE ROTOR WITH PURGE BLADES

BACKGROUND

This application relates to rotors for use in gas turbine engines, where purge blades generate a pressure to resist ingestion of hot gas.

Gas turbine engines are known, and typically include a compressor compressing air, and delivering the air into a combustion section. The air is mixed with fuel and combusted in the combustion section. Products of this combustion pass downstream over turbine rotors. The turbine rotors may include a rotor with removable blades. Alternatively, integrally bladed rotors wherein the rotor and the blades are formed as one, are also known.

In addition to the flow of hot combustion products across the turbine rotors, cool air is also delivered. The cool air serves to cool the rotor and blades, since they operate in a very high temperature. In addition, another purpose of the cool air is to provide a "purge" flow which resists the ingestion of the hot combustion products into the area of the rotor and blade interface. As an example, in one type removable blade, a so-called "fir-tree" includes a plurality of segments which are inserted into corresponding fir-tree grooves in the rotor. The blade is held into the disc by locking features such as a clip or rivet.

However, at times, if the hot gas combustion products are ingested into the area of the fir-tree, there can be challenges raised. As one example, a concern known as both blade and disc creep occurs when there is plastic deformation of the blade and disc. This can occur if they are subjected to temperatures beyond a material creep resistance capability.

Another concern is so-called "blade walking." Blade walking typically occurs at startup of the gas turbine engine when there may be insufficient cooling air. The blade will heat more rapidly than the rotor, and thus the blade may move axially within the groves in the rotor. That occurs since the difference in thermal gradient between the disc and blade at the fir-tree gives rise to forces that overcome the strength of the locking features holding them together. As a consequence relative motion between disc and blade takes place. This is known as blade-walking.

Both of the above occurrences are undesirable.

SUMMARY

A rotor for a gas turbine engine includes a plurality of turbine blades extending radially outwardly of a rotor body. A plurality of purge blades is positioned to rotate with the rotor body, and to drive air radially outwardly toward the turbine blades.

DETAILED DESCRIPTION

Figure 1:
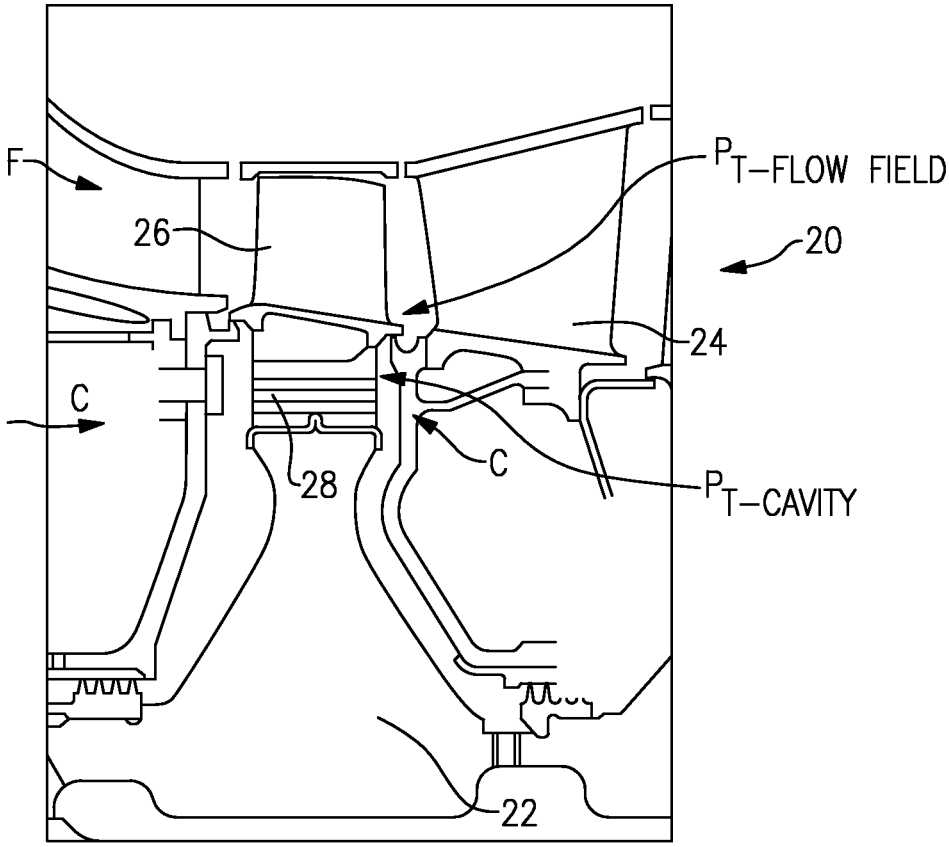
FIG. 1 shows a turbine section in a gas turbine engine.

FIG. 1 discloses a turbine section 20. As shown, a rotor 22 is positioned adjacent to a series of vanes 24. A turbine blade 26 has a fir-tree connection 28 received within a groove within rotor 22.

As shown, there is combustion gas flow F, which moves across the turbine blades 26, driving them to rotate with the rotor 22. This flow is extremely hot. To resist ingestion of this hot gas flow into the area of the fir-tree 28, cooling air flows C are also supplied both at the upstream and downstream end of the rotor 22.

If insufficient cooling airflow is provided to purge or resist the hot gas flow, then blade creep and blade-walking can occur. On the other hand, too much cooling air flow decreases the efficiency of the overall gas turbine engine. As such, it is desirable to optimize the amount of airflow, while still ensuring it is sufficient to prevent ingestion of the hot gas.

Figure 2:
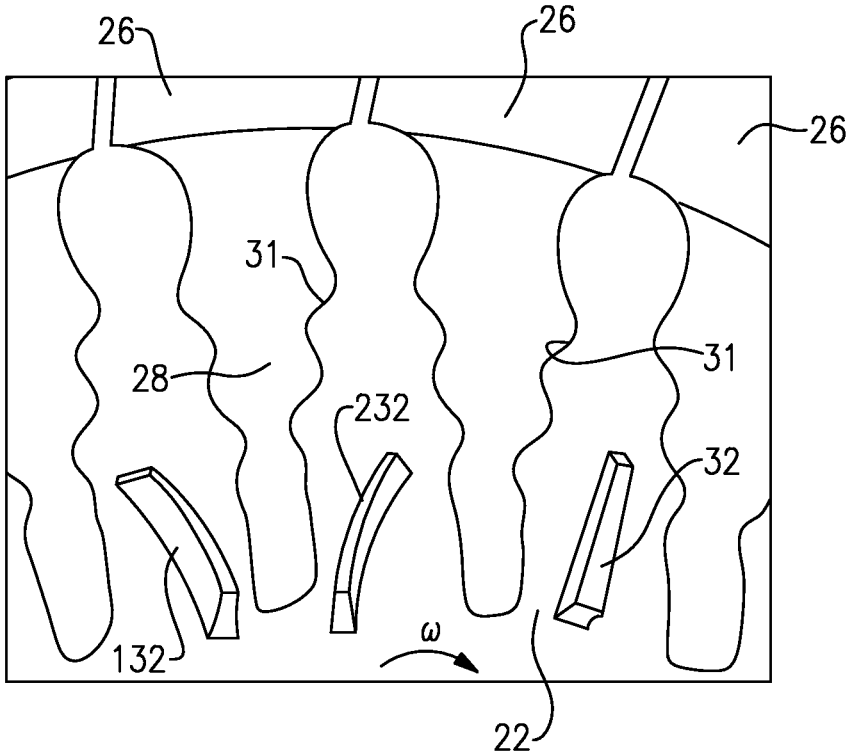
FIG. 2 shows a detail of a turbine rotor.

FIG. 2 shows an embodiment wherein the rotor 22 has grooves 31 interfitting with the fir-trees 28. As also shown, purge blades 32, 132, 232 are formed on the rotor and within a radial extent of the grooves 31. The purge blade is part of the turbine disc rim.

The purge blades 32, 132, 232 are formed on the downstream end of the rotor 22, although they may also be utilized on the upstream end if desired.

Figure 3A:
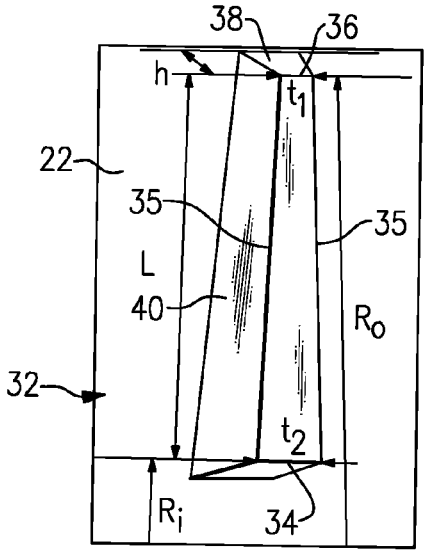
FIGS. 3A shows a purge blade.

FIG. 3A shows a detail of one purge blade 32. As shown, the purge blade 32 has an outer face that is generally trapezoidal, with angled sides 35 extending between a top 36 and a larger bottom 34. The sides 35 provide a purge blade profile that will serve to move air when the rotor 22 is rotated. As shown, the purge blade 32 stands away from the nominal face of the rotor 22 by a distance h, and as shown at 38. In addition, sides 40 extend for a length L. A radius $R_0$ from a centerline of the gas turbine engine to the top 38 of the blade is defined, while another radius $R_i$ is defined to the bottom face 34.

Figure 3B:
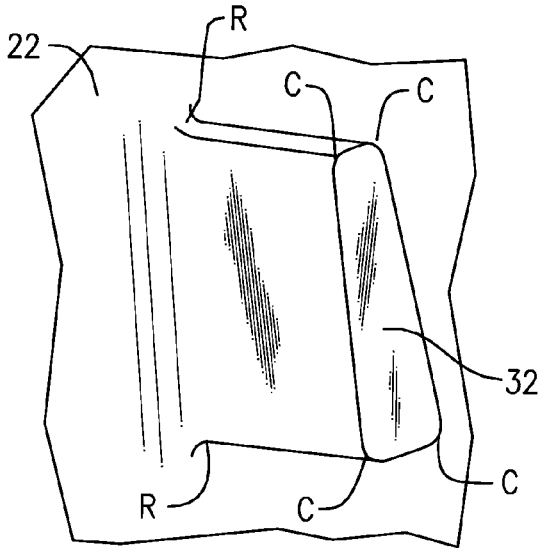
FIG. 3B shows another detail of the FIG. 3A blade.

As shown in FIG. 3B, the purge blade 32 may actually extend from the rotor 22 with a radius R. For purposes of this application, the shape of the purge blade may be defined as "trapezoidal." However, as shown in FIG. 3B, corners C of the trapezoidal shape may be rounded. This shape would still be known as "trapezoidal" for purposes of interpreting this application.

The dimensions of the blade are designed to ensure that sufficient airflow will be generated to resist ingestion of hot air into the area of the fir-tree but not utilizing an excessive amount.

As is clear, the purge blade 232 can be swept forward, or in the direction of rotation ω, or may be swept rearwardly as shown at 132, or against the direction of rotation.

To prevent hot gas ingestion, the following is required to be satisfied (refer to FIG. 1)

$$P_{T\text{-}cavity} \geq PT\text{-}flowfield\text{-}Max$$

Where $P_{T\text{-}cavity}$=disc rim cavity total pressure $P_{T\text{-}flowfield\text{-}Max}$=Maximum total pressure of the flow field above the blade platform It is desirable that the pressure outwardly of the purge blades be greater than the pressure in the hot gas flow F at the location of the purge blades. Thus, the mass flow rate is selected to ensure this additional pressure. In calculating the change in pressure, the following formula will apply:

$$\dot{m}=\rho 2\pi R_2 h\, W$$

Where:

W=velocity of the cooling air relative to the purge blade

ρ=air density $R_2$ is the outer radius of the control volume (purge blade outside radius)

h is the purge blade height

L is purge blade length

The disc rim cavity pressure at the control volume exit, $P_{T\text{-}cavity}$, is equal to the pressure at the control volume entrance plus the increase in pressure, Δp, due to energy transferred from the purge blade to the air. It can be simply expressed as:

$$\Delta p = \frac{\rho}{2g_c}[U_2^2 - U_1^2] + \frac{\rho}{2g_c}[V_2^2 - V_1^2]$$

Where:

$U_i$=peripheral velocity of the turbine disc at $R_2$ and $R_1$ (purge blade outer and inner radii)

$V_1$=peripheral velocity of the air at $R_2$ and $R_1$ (purge blade outer and inner radii)

$$\frac{\rho}{2g_c}[U_2^2 - U_1^2],$$

the first term of the above equation, represents the increase in static pressure due to the centrifugal effect acting on the air.

$$\frac{\rho}{2g_c}[V_2^2 - V_1^2],$$

the second terms of the above equation represents the increase in kinetic energy due to the energy transferring from the purge blade to the air.

The dimensions can thus be selected to achieve adequate pressure increase from the purge blades to resist the ingestion of the hot combustion gases.

Figure 4:
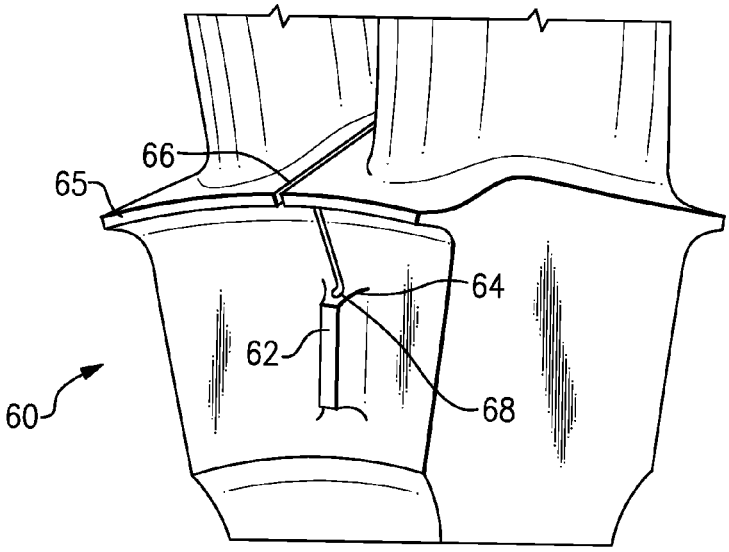
FIG. 4 shows another embodiment.

FIG. 4 shows an embodiment 60 wherein purge blade 62 is incorporated into an integrally bladed rotor. As shown, the purge blade 62 has a curved side face 64. Stress relief slot 66 is formed from a lip of the rotor 65 downwardly to a top surface 68 of the blade. Similar calculations would be used to define the size and shape of the blades. Slot 66 may extend through the full thickness of the disc rim from the front to the back.

Figure 5:
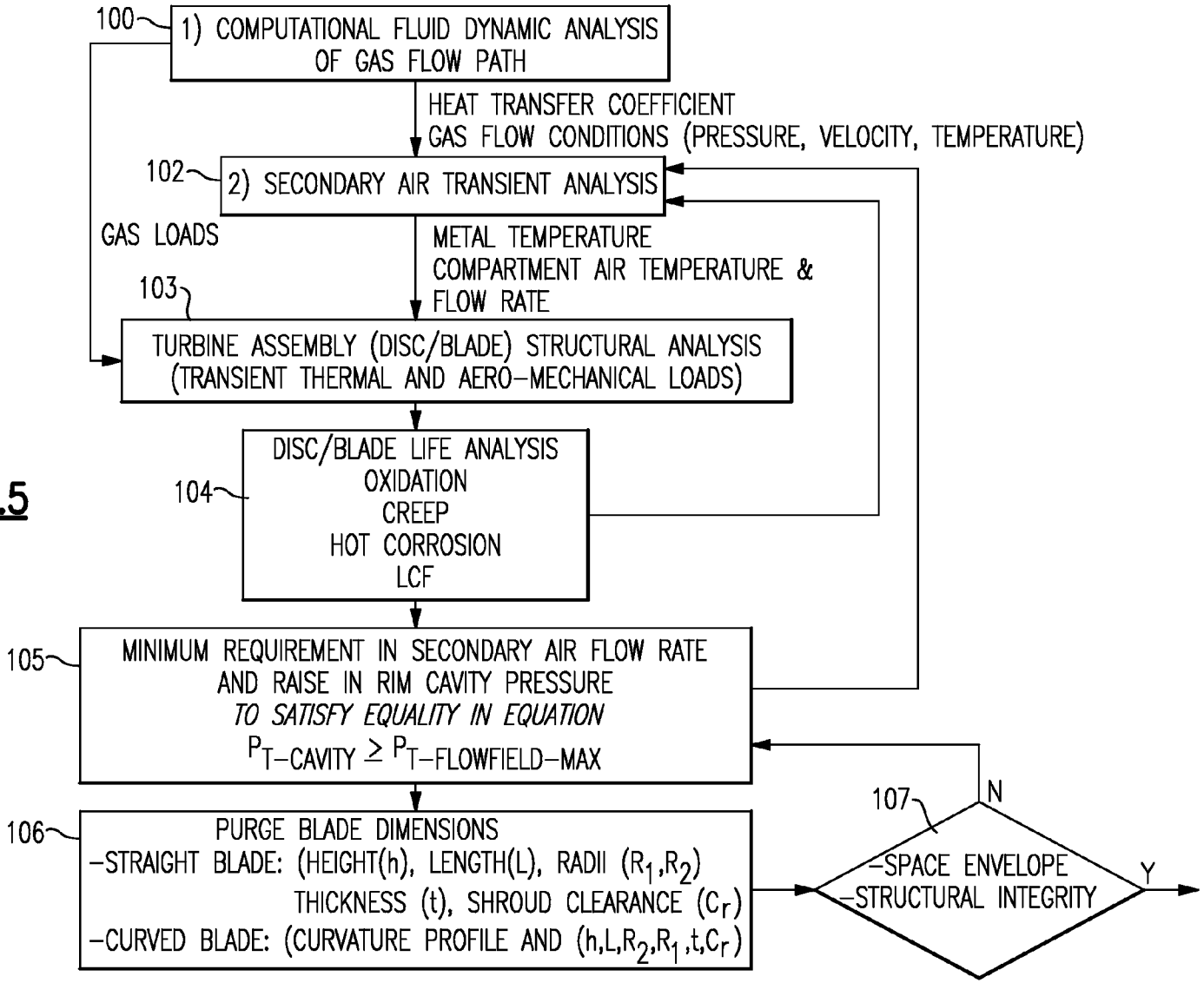
FIG. 5 is a flow chart.

FIG. 5 is a flow chart of a method of designing purge blade dimensions.

First, at step 100, a fluid dynamic analysis of a gas flow path for an engine which is to incorporate this blade and rotor is performed. From this analysis, which a worker of ordinary skill in the art would know how to perform, a heat transfer coefficient, and gas flow conditions including pressure, velocity and temperature are determined. Next, at step 102, a secondary air transient analysis is made. This would include an analysis of the cooling air flow. From this secondary air transient analysis, a temperature of the metal associated with the blade and rotor, compartment air temperature, and flow rates are identified. At step 103, a structural analysis is made of the turbine assembly, including the disc or rotor and the blades. Transient thermal and mechanical loads are analyzed. From this, at step 104, a disc or rotor and blade life analysis is performed, including consideration of oxidation, creep, hot corrosion and low cycle fatigue (LCF).

At step 105, an amount of secondary airflow necessary to raise the rim cavity pressure to satisfy the equation set forth above at paragraph 20 is performed. Notably, after some of the steps, the flow chart returns to step 102 to re-perform that analysis, and provide better information flowing downstream.

At step 106, the dimensions of the purge blade including its various dimensions, and utilizing paragraphs 21 and 22 is performed. Finally, an envelope and structural integrity analysis is made at step 107 after the purge blade dimensions have been analyzed.

Although embodiments of this invention have been disclosed, a worker of ordinary skill would recognize that certain modifications would come within the scope of this invention. For that reason, the following claims should be studied to determine the true scope and content of this invention.

What is claimed is:

1. A rotor for a gas turbine engine comprising:

a rotor body centered about a central axis;

a plurality of turbine blades extending radially outwardly of said rotor body;

a plurality of purge blades to rotate with said rotor body, and to drive air radially outwardly toward said turbine blades;

said turbine blades are removable from said rotor body; and said turbine blades have fir-trees that are received in corresponding grooves in said rotor body and said purge blades are positioned within a radial distance of said grooves on said rotor.

2. The rotor as set forth in claim 1, wherein dimensions of said purge blades are designed to ensure adequate pressure flowing from said purge blades to resist hot gas ingestion.

3. The rotor as set forth in claim 1, wherein said purge blades have a curved side to create airflow.

4. The rotor as set forth in claim 3, wherein said curved side is curved in the direction of rotation of the rotor.

5. The rotor as set forth in claim 3, wherein said curved side is curved away from the direction of rotation of the rotor.

6. The rotor as set forth in claim 1, wherein said purge blades have a generally trapezoidal outwardly facing surface.

7. The rotor as set forth in claim 1, wherein said purge blades are positioned on a downstream side of said rotor.

8. The rotor as set forth in claim 1, wherein said purge blades are positioned on an upstream side of said rotor.

9. The rotor as set forth in claim 1, wherein dimensions of said purge blades are selected to ensure that an airflow rate generated by the purge blades is sufficient to cause a pressure to resist the flow of hot gas radially inwardly, and to the area of the purge blade.

10. A rotor for a gas turbine engine comprising:

a rotor body centered about a central axis;

a plurality of turbine blades extending radially outwardly of said rotor body;

a plurality of purge blades to rotate with said rotor body, and to drive air radially outwardly toward said turbine blades;

said rotor body and said turbine blades are part of an intergrally bladed rotor;

stress relief slots are included; and said stress relief slots extend from a lip of said rotor body to a position radially outwardly of said purge blades.

11. The rotor as set forth in claim 10, wherein said stress relief slots extend through an entire axial length of said rotor, and from a front of said rotor to a rear of said rotor.

12. The rotor as set forth in claim 10, wherein said relief slots extend to a top surface of said purge blades.

13. A method of designing purge blades to be associated with a rotor in a turbine rotor for use in a gas turbine engine comprising the steps of:

(a) providing a turbine rotor;

(b) identifying a pressure $P_{T\text{-}flowfield\text{-}Max}$ outwardly of a location for purge blades on a turbine rotor, and identifying a minimum pressure increase necessary such that purge blades will increase a rim cavity pressure $P_{T\text{-}Cavity}$ such that $P_{T\text{-}Cavity} \geq P_{T\text{-}flowfield\text{-}Max}$; and (c) identifying purge blade dimensions to ensure the rim cavity pressure increase occurs; and (d) Forming the purge blades on the turbine rotor.

14. The method as set forth in claim 13, wherein said purge blades have a straight side.

15. The method as set forth in claim 13, wherein said purge blades have a curved side.

* * * * *